US010381131B2

(12) United States Patent
Sakaguchi

(10) Patent No.: US 10,381,131 B2
(45) Date of Patent: Aug. 13, 2019

(54) WIRE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Kiyokazu Sakaguchi, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/763,134

(22) PCT Filed: Sep. 6, 2016

(86) PCT No.: PCT/JP2016/076070
§ 371 (c)(1),
(2) Date: Mar. 26, 2018

(87) PCT Pub. No.: WO2017/051698
PCT Pub. Date: Mar. 30, 2017

(65) Prior Publication Data

US 2018/0277281 A1 Sep. 27, 2018

(30) Foreign Application Priority Data

Sep. 24, 2015 (JP) ..... 2015-186995

(51) Int. Cl.
*H01B 5/08* (2006.01)
*H01B 7/04* (2006.01)
(Continued)

(52) U.S. Cl.
CPC ..... *H01B 7/04* (2013.01); *H01B 7/0009* (2013.01); *H01B 13/02* (2013.01)

(58) Field of Classification Search
CPC ..... H01B 5/08
(Continued)

(56) References Cited

U.S. PATENT DOCUMENTS 6,019,736 A * 2/2000 Avellanet ..... A61M 25/09 600/585
6,649,844 B2 * 11/2003 Kusumoto ..... H02K 3/12 174/128.1
(Continued)

FOREIGN PATENT DOCUMENTS

JP 2006-156346 6/2006
JP 2012-79563 4/2012
(Continued)

OTHER PUBLICATIONS

International Search Report dated Oct. 25, 2016.

*Primary Examiner* — Chau N Nguyen
(74) *Attorney, Agent, or Firm* — Gerald E. Hespos; Michael J. Porco; Matthew T. Hespos

(57) ABSTRACT

A wire W1 is a wire W1 in which a plurality of strand conductors 11 are twisted at a predetermined twist pitch P1 and which includes a bent portion 20 having a bent shape with a curvature K. A section length L1 of the bent portion 20 is an integer multiple of the twist pitch P1.

3 Claims, 9 Drawing Sheets

(51) Int. Cl.
*H01B 7/00* (2006.01)
*H01B 13/02* (2006.01)

(58) Field of Classification Search
USPC ..... 174/128.1
See application file for complete search history.

(56) References Cited

U.S. PATENT DOCUMENTS

| | | | | |
|---|---|---|---|---|
| 7,426,821 | B2 * | 9/2008 | Soenen | B23K 1/0008 57/236 |
| 9,511,726 | B2 * | 12/2016 | Hayakawa | B60R 16/0215 |
| 2007/0251204 | A1 | 11/2007 | Susai et al. | |
| 2013/0168127 | A1 | 7/2013 | Matsuno | |
| 2015/0096781 | A1 * | 4/2015 | Fichtner | H01B 13/0006 174/102 R |

FOREIGN PATENT DOCUMENTS

| | | |
|---|---|---|
| JP | 2014-93169 | 5/2014 |
| JP | 2014-143217 | 8/2014 |

* cited by examiner

WIRE

BACKGROUND

Field of the Invention

This specification relates to a wire.

Description of the Related Art

Conventional coated wires used for wiring of vehicles, electric and electronic devices and the like have a conductor coated with an insulator. A conductor of this wire generally is configured by twisting a plurality of metal strands. If a stranded conductor formed by twisting the strands in this way is bent, a length differs for each of the strands located on an inner peripheral side and an outer peripheral side in a bent portion. Thus, if an end of the stranded conductor is not fixed, end parts of respective strands 1*a* of a wire 1 are irregular, as shown in FIG. 8. Further, if the end of the stranded conductor is fixed, such as by a terminal 6, a bent portion 7 of a wire 5 bulges, as shown in FIG. 9. If these shape abnormalities are corrected, the inherent flexibility of the stranded conductor is impaired.

Japanese Unexamined Patent Publication No. 2014-143217 attempts to improve the flexibility and bending resistance of the wire by adjusting a twist pitch and a strand diameter of the wire. However, in the configuration of Japanese Unexamined Patent Publication No. 2014-143217, cost may increase since a dedicated wire needs to be prepared to avoid shape abnormalities of a bent portion of the wire.

SUMMARY

This specification relates to a wire in which strand conductors are twisted at a predetermined twist pitch. The wire includes a bent portion having a bent shape with a predetermined curvature, and a section length of the bent portion is an integer multiple of the twist pitch. Accordingly since of all the strand conductors are equally distributed on inner and outer peripheral sides in the bent portion so that the route lengths of the respective strand conductors in the bent portion are equal. Therefore, the flexibility of the wire is not impaired and, even if an end of the wire is fixed, the bent portion does not bulge.

The above-described configuration with strand conductors twisted at a predetermined twist pitch and having a bent portion can be manufactured by being bent such that a section length of the bent portion is equal to an integer multiple of the twist pitch.

The wire may have a plurality of bent portions and a straight portion linearly connecting between the respective bent portions. In this configuration, the sum of section lengths of the respective bent portions and the sum of section lengths of the straight portions are both an integer multiple of the twist pitch According to this configuration, even in the wire including the straight portion in an intermediate part, total route lengths of the respective strand conductors in the plurality of bent portions are equal. Further, the twist pitch is maintained in the straight portion. Therefore, the flexibility of the wire is not impaired and, even if an end of the wire is fixed, the bent portion does not bulge.

As described above, the wire may be bent such that the sum of section lengths of the respective bent portions and the sum of section lengths of the straight portions are both an integer multiple of the twist pitch.

There may be two bent portions, and the section lengths of the two bent portions may be equal and half the integer multiple of the twist pitch.

Even in the wire that is U-shaped by the two bent portions and the straight portion therebetween, the route lengths of the respective strand conductors are equal by having this configuration.

According to the wire disclosed in this specification, it is possible to prevent an end part of the wire from becoming irregular and to prevent the conductor strands from bulging in the bent portion even if the wire is a stranded wire and includes the bent portion.

DETAILED DESCRIPTION

A wire W used in each embodiment is described with reference to FIG. 1.

The wire W has a core 13 formed by twisting strand conductors 11 at a predetermined twist pitch P, and the core 13 is coated by an insulation coating 15. The twist pitch P indicates a length by which the strand conductors 11 advance along an axial direction of the wire W by twisting rotation while making one turn. That is, the twist pitch P indicates a length of the wire W in a longitudinal direction required for the strand conductors 11 to rotate 360°.

First Embodiment

Figure 1:
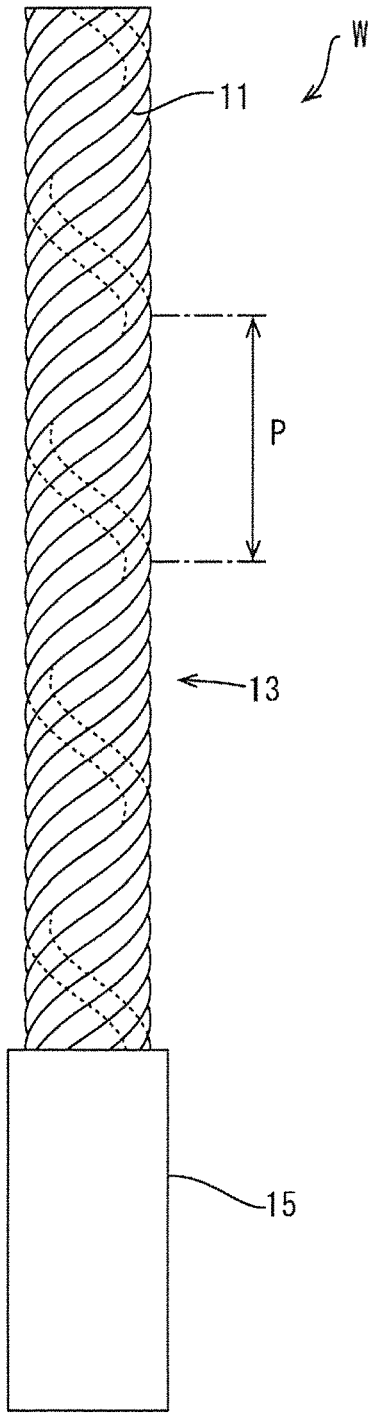
FIG. 1 is a front view of a wire before being bent in each embodiment.
Figure 2:
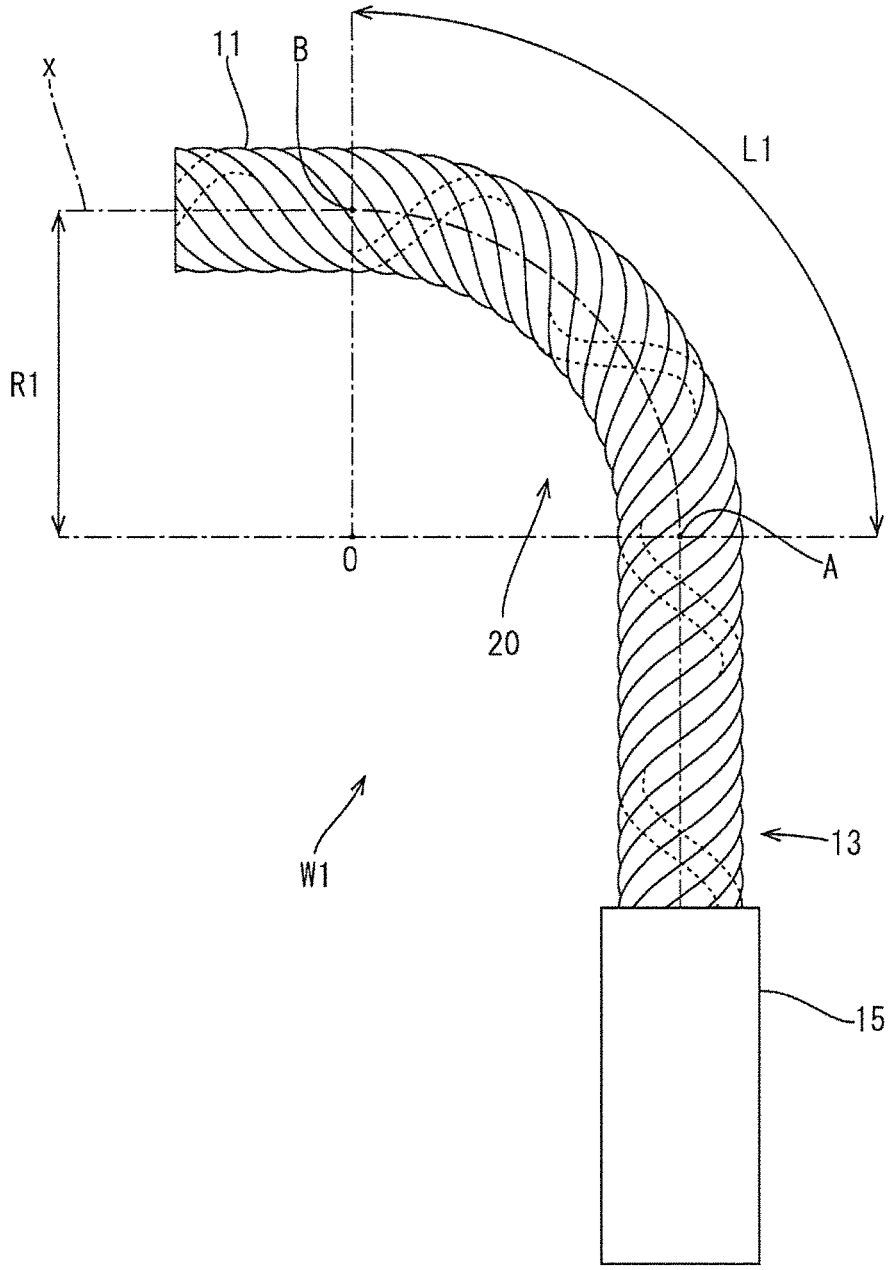
FIG. 2 is a front view of a wire in a first embodiment.
Figure 3:
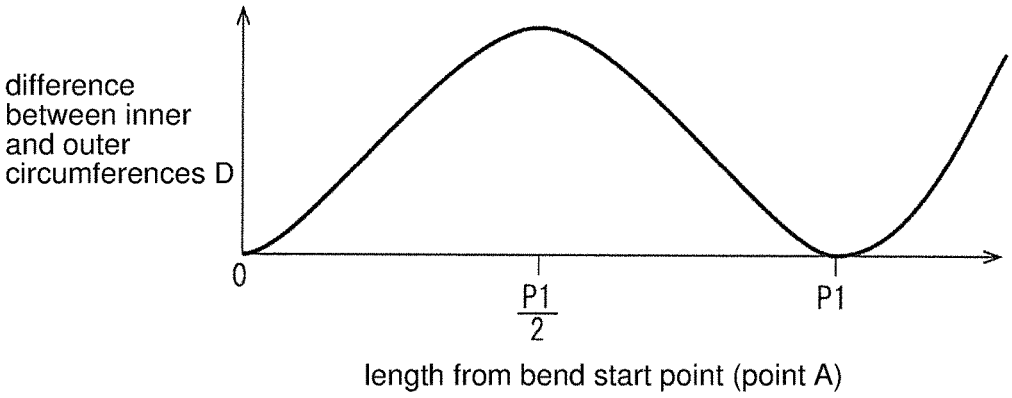
FIG. 3 is a graph showing a wire pitch and a difference between inner and outer circumferences of strands.

A wire W1 of this embodiment is described with respect to FIGS. 2 and 3. In this embodiment, as shown in FIG. 2, the wire W is one type of the wire shown in FIG. 1 and has a bent portion 20 bent at a radius of curvature R1. The bent portion 20 is provided in a part where a core 13 formed by twisting strand conductors 11 at a twist pitch P1 is exposed, and is bent such that a line along the wire W1 between a point A (bend start point) and a point B (bend end point) forms an arc of approximately 90°. Note that the radius of curvature R1 is a distance from a center axis x of the core 13 to a center of curvature O. Further, a curvature K1 serving as an index of a bent state is defined as an inverse of the radius of curvature (K1=1/R1). That is, the wire W1 has the bent portion 20 bent with the curvature K1.

A section length L1 of the bent portion 20 indicates a length of a section where the wire W1 is bent (length from the point A to the point B) as shown in FIG. 2. More specifically, the section length L1 is a length from the point A to the point B in a state before the bent portion 20 is bent (natural state) and a length of the bent portion 20 along the center axis x in the bent portion 20. Note that the center axis x is an axis extending in an axial direction (longitudinal direction) of the wire W1 passing through a center position in a radial direction of the core 13.

In the bent portion 20, the strand conductors 11 of the wire W1 in a part outward of the center axis x extend along a longer route as compared to an unbent state, and the strand conductors 11 of the wire W1 in a part inward of the center axis x extend along a shorter route as compared to the unbent state. As a result, the strand conductors 11 are lacking on the side outward of the center axis x, and the strand conductors 11 become redundant on the side inward of the center axis x. Due to such excesses and deficiencies of the respective strand conductors 11, a difference D between inner and outer circumferences is present among the respective strand conductors 11.

As each strand conductor 11 moves in the longitudinal direction thereof, the position of each strand conductor 11 with respect to the center axis x also moves according to twisting rotation (twist pitch P1). A value of an excess and deficiency dL of each strand conductor 11 in the bent portion 20 has periodicity with respect to the twist pitch P1 by accumulating the excesses and deficiencies from the start point of the bent portion 20. As a result, the difference D between inner and outer circumferences among the respective strand conductors 11 also has periodicity with respect to the twist pitch P1.

As shown in FIG. 3, the difference D between inner and outer circumferences of each strand conductor 11 is largest when the length from the point A is P1/2 (half value of the twist pitch) and 0 when the length from the point A is the twist pitch P1. Since a difference D between inner and outer circumferences of the wire W1 bent with the same curvature K1 has periodicity with respect to the twist pitch P1, the difference D between inner and outer circumferences is 0 when the length from the point A is an integer multiple of the twist pitch P1. That is, the difference D between inner and outer circumferences of the bent portion 20 is 0 when the section length L1 of the bent portion 20 is an integer multiple of the twist pitch P1.

When the difference D between inner and outer circumferences of the bent portion 20 is 0 as just described, the excess and deficiency dL of each strand conductor 11 in the bent portion 20 is also 0. That is, when the section length L1 of the bent portion 20 is an integer multiple of the twist pitch P1, route lengths of the respective strand conductors 11 in the bent portion 20 become equal and end parts at the start points and the end points of the respective strand conductors having an equal route length are aligned by tensile forces of the respective strand conductors 11. Further, when the section length L1 of the bent portion 20 is an integer multiple of the twist pitch P1, all of the strand conductors 11 are distributed equally on inner and outer peripheral sides in the bent portion 20.

As just described, if the wire W1 is bent such that the section length L1 of the bent portion 20 is an integer multiple of the twist pitch P1, the wire W1 can be bent without the flexibility thereof being impaired. Further, if the section length L1 of the bent portion 20 is an integer multiple of the twist pitch P1, the bent portion 20 does not bulge even if the end of the wire W1 is fixed.

Second Embodiment

Figure 4:
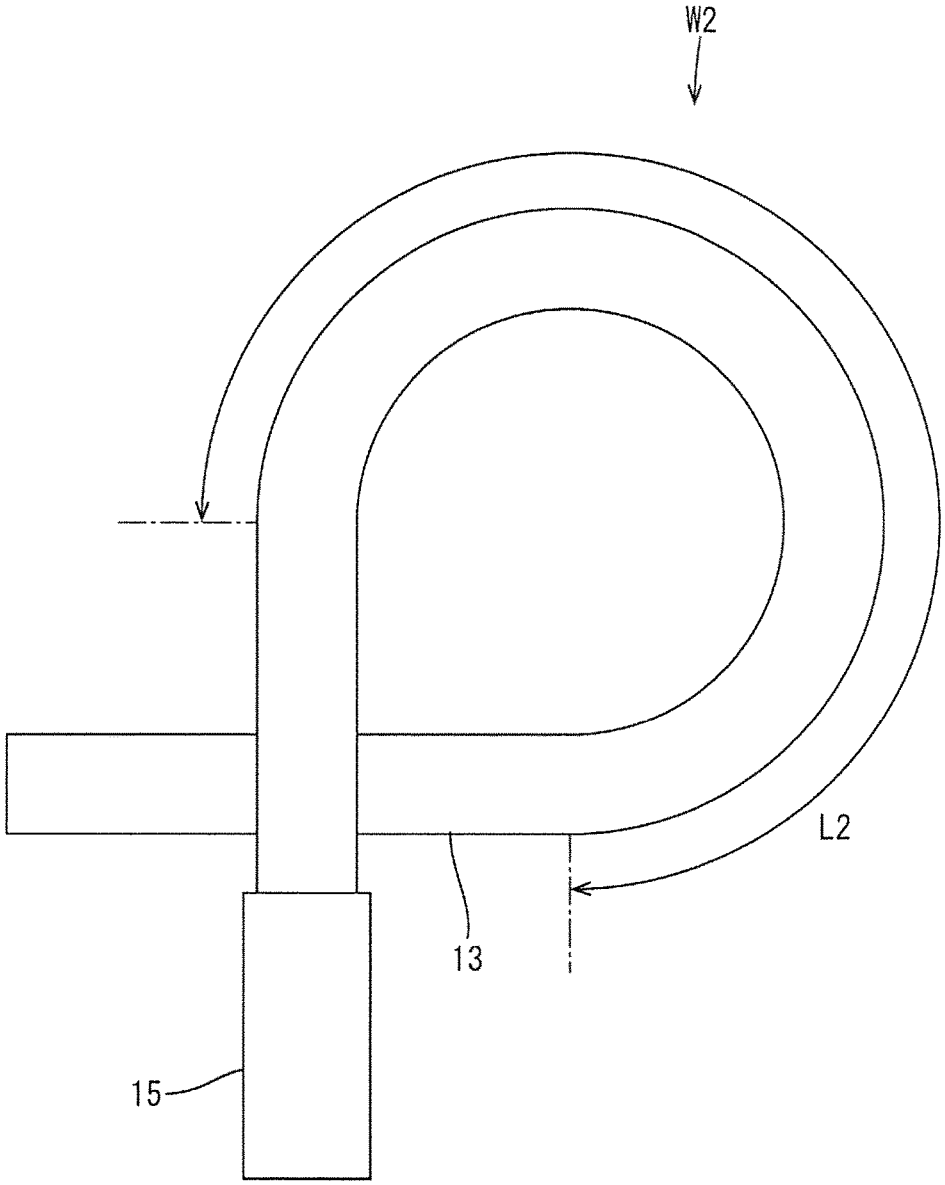
FIG. 4 is a schematic front view of a wire in a second embodiment.

A wire W2 with a bent portion 120 having a different shape is described using FIG. 4. Note that the same components as in the first embodiment are denoted by the same reference signs and are not described. Further, each strand conductor 11 is not shown to simplify the drawing.

In this embodiment, as shown in FIG. 4, the wire W2 as one type of the wire shown in FIG. 1 includes the bent portion 120 having a bent shape with a curvature K2. The bent portion 120 is provided in a part where a core 13 formed by twisting strand conductors 11 at a twist pitch P2 is exposed, and bent such that a line along the wire W2 between a start point and an end point forms an arc of approximately 270°.

As in the first embodiment, when a section length L2 of the bent portion 120 is an integer multiple of the twist pitch P2, a difference D between inner and outer circumferences of the bent portion 120 is 0. That is, when the section length L2 of the bent portion 120 is an integer multiple of the twist pitch P2, route lengths of the respective strand conductors 11 in the bent portion 120 become equal and all of the strand conductors 11 are distributed equally on inner and outer peripheral sides in the bent portion 120.

As just described, if the wire W2 is bent such that the section length L2 of the bent portion 120 is an integer multiple of the twist pitch P2, the wire W2 can be bent without the flexibility thereof being impaired. Further, if the section length L2 of the bent portion 120 is an integer multiple of the twist pitch P2, the bent portion 120 does not bulge even if the end of the wire W2 is fixed.

Third Embodiment

Figure 5:
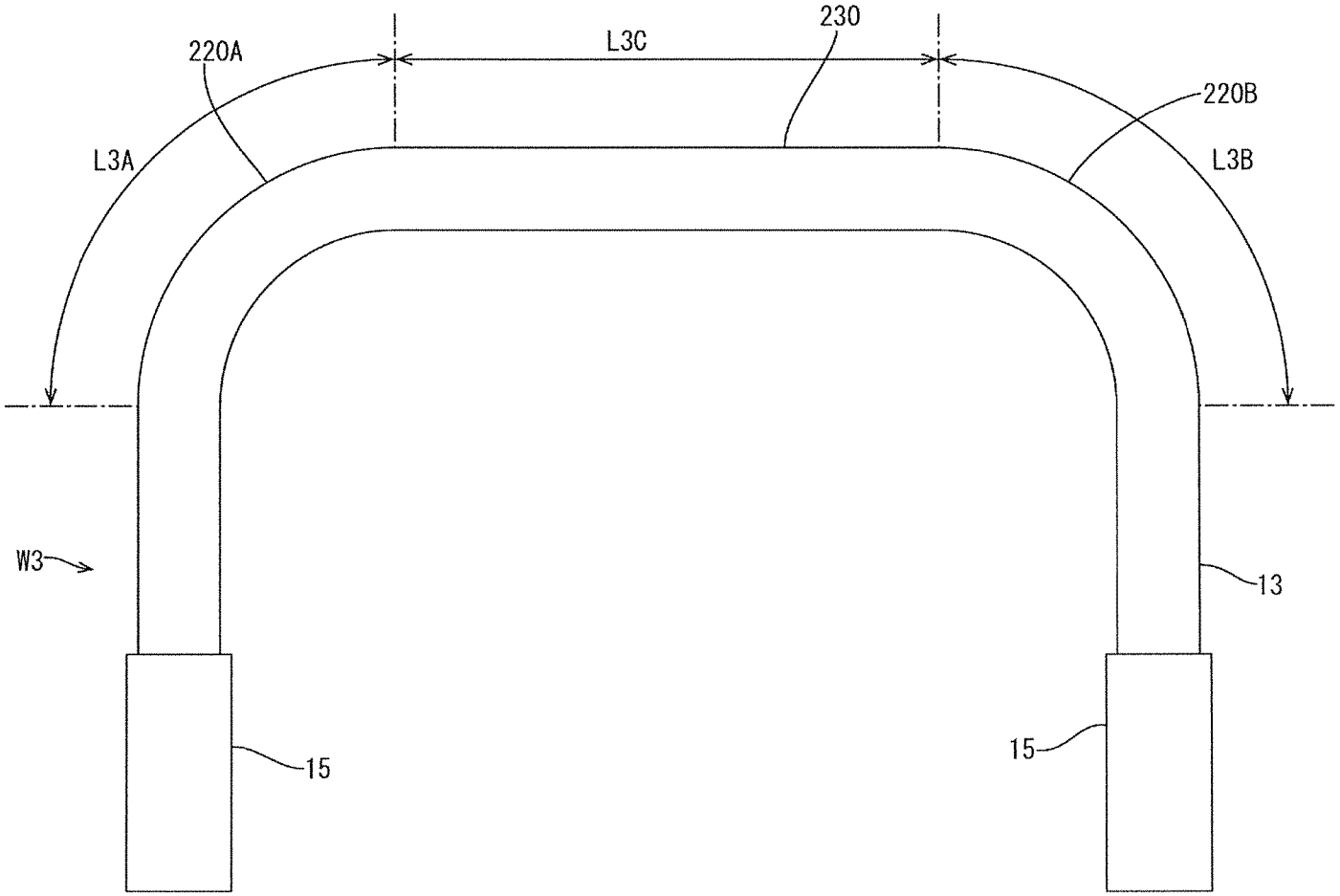
FIG. 5 is a schematic front view of a wire in a third embodiment.

A wire W3 with bent portions 220 having a different shape is described using FIG. 5. Note that the same components as in the first embodiment are denoted by the same reference signs and are not described. Further, each strand conductor 11 is not shown to simplify the drawing.

In this embodiment, as shown in FIG. 5, the wire W3 as one type of the wire shown in FIG. 1 includes two bent portions 220 having a bent shape with a curvature K3 and a straight portion 230 linearly connecting between the respective bent portions 220. The bent portions 220 and the straight portion 230 are provided in a part where a core 13 formed by twisting strand conductors 11 at a twist pitch P3 is exposed. Each bent portion 220 is bent with the same curvature K3 such that a line along the wire W3 between a bend start point and a bend end point of the bent portion 220 forms an arc of approximately 90°. The straight portion 230 is provided between the respective bent portions 220 and the respective bent portions 220 and the straight portion 230 are located on the same plane. Thus, the wire W is bent into a U shape.

A section length L3A of the first bent portion 220A is ½ of the twist pitch P3 and a section length L3B of the second bent portion 220B is also ½ of the twist pitch P3. Further, a section length L3C of the straight portion 230 is an integer multiple of the twist pitch P3. As shown in FIG. 3, the difference D between inner and outer circumferences of each strand conductor 11 is largest when the length from the bend start point is a half value of the twist pitch P. Thus, the difference D between inner and outer circumferences of the wire W3 is largest when the length is ½ of the twist pitch P3.

The section length L3A of the first bent portion 220A is ½ of the twist pitch P3. Thus, the difference D between inner and outer circumferences at the bend end point of the one bent portion 220A is largest. The difference D between inner and outer circumferences and an excess and deficiency dL of each strand conductor 11 are maintained without any deviation also in the straight portion 230 since the section length L3C of the twist pitch 230 is an integer multiple of the twist pitch P3. As just described, the bend start point of the second bent portion 220B is reached with the excesses and deficiencies dL of the strand conductors 11 and the difference D between inner and outer circumferences caused in the first bent portion 220A maintained.

The section length L3B of the second bent portion 220B is ½ of the twist pitch P3 and the sum of the section lengths L3A, L3B is an integer multiple of the twist pitch P3. Further, each bent portion 220 is bent with the same curvature K3, and the excesses and deficiencies dL of the respective strand conductors 11 and the difference D between inner and outer circumferences caused at the same length are equal. Thus, the excesses and deficiencies dL of the strand conductors 11 and the difference D between inner and outer circumferences caused in the second bent portion 220B and the excesses and deficiencies dL of the strand conductors 11 and the difference D between inner and outer circumferences maintained in the straight portion 230 cancel out each other and the difference D between inner and outer circumferences at the end point of the second bent portion 220B is 0.

That is, when the sum of the section lengths L3A, L3B of a plurality of the bent portions 220A, 220B is an integer multiple of the twist pitch P3, route lengths of the respective strand conductors 11 in the case of summing the respective bent portions 220 become equal. Further, by setting the section length L3C of the straight portion 230 at an integer multiple of the twist pitch P3, the bend start point of the second bent portion 220B is reached with the excesses and deficiencies dL of the strand conductors 11 and the difference D between inner and outer circumferences caused in the first bent portion 220A maintained.

As described above, according to the third embodiment, the wire W3 has strand conductors 11 twisted at the predetermined twist pitch P3 and includes the bent portions 220 having a bent shape with the predetermined curvature K3 and the straight portion 230 linearly connecting between the respective bent portions 220. Additionally, the sum of the section lengths L3A, L3B of the bent portions 220 and the sum of the section length(s) of the straight portion(s) 230 are both an integer multiple of the twist pitch P3.

As just described, if the wire W3 includes the straight portion 230 between the bent portions 220, the wire W3 can be bent without the flexibility thereof being impaired. Further, the bent portion 220 does not bulge even if the end of the wire W3 is fixed.

Fourth Embodiment

Figure 6:
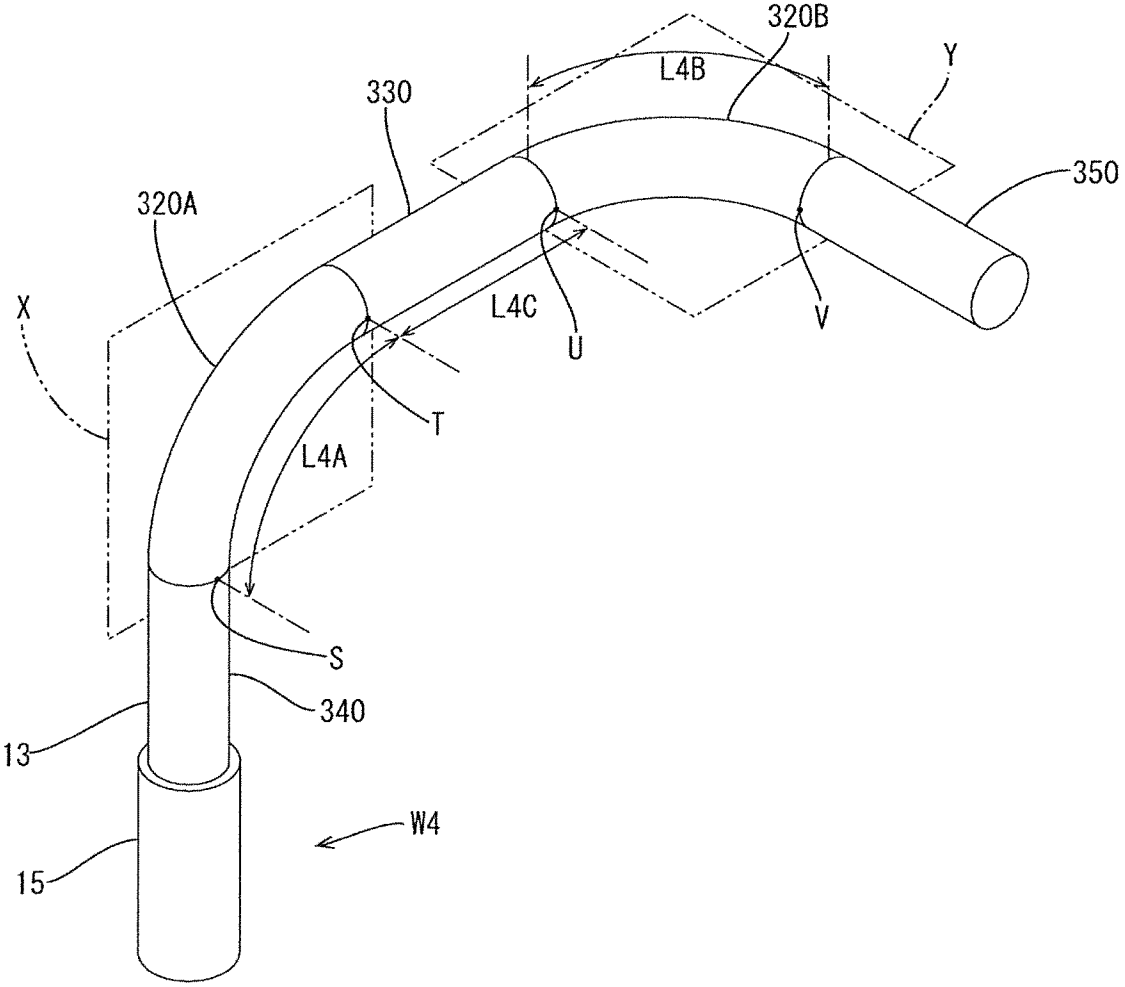
FIG. 6 is a schematic perspective view of a wire in a fourth embodiment.
Figure 7:
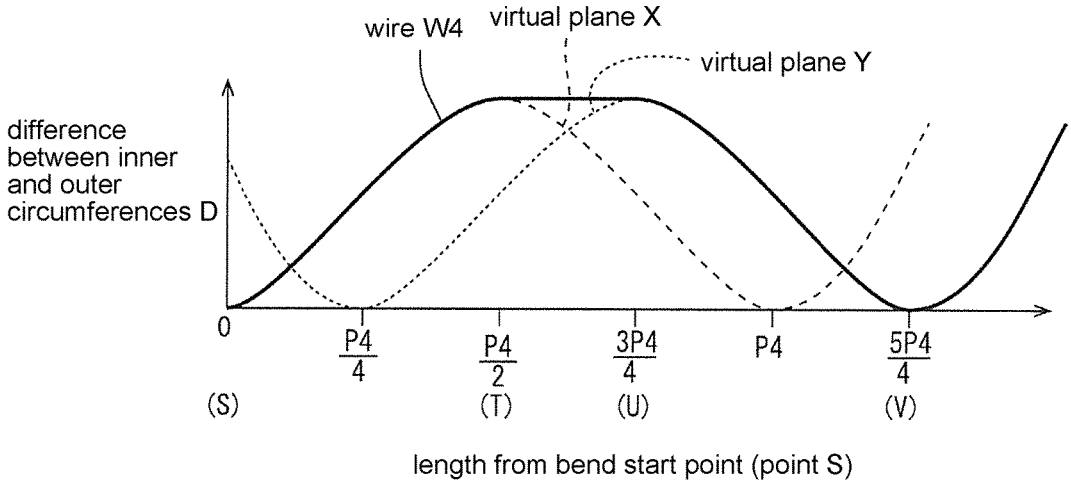
FIG. 7 is a graph showing a wire pitch and a difference between inner and outer circumferences of strands.
Figure 8:
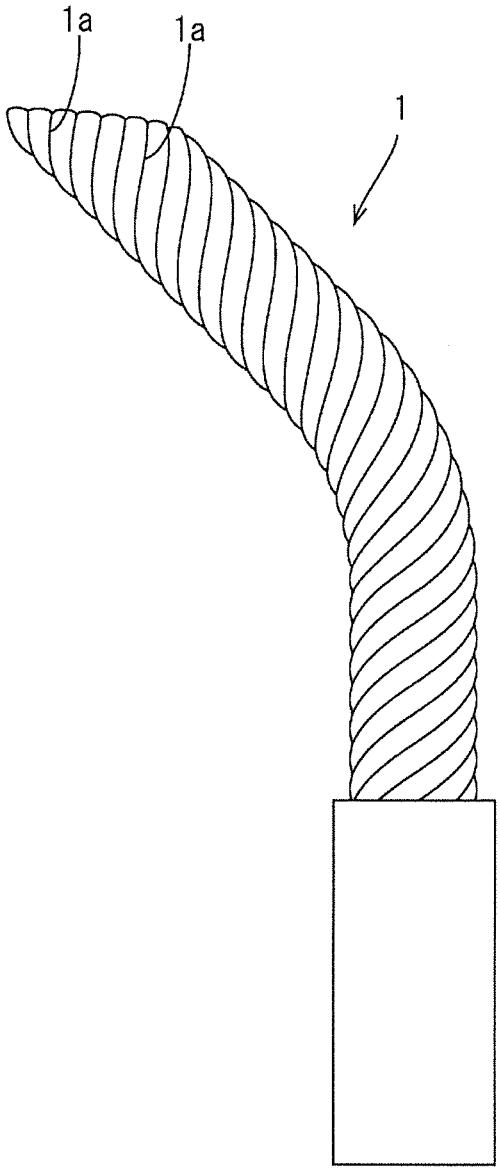
FIG. 8 PRIOR ART
FIG. 8 is a front view of a conventional wire with a bent free end.
Figure 9:
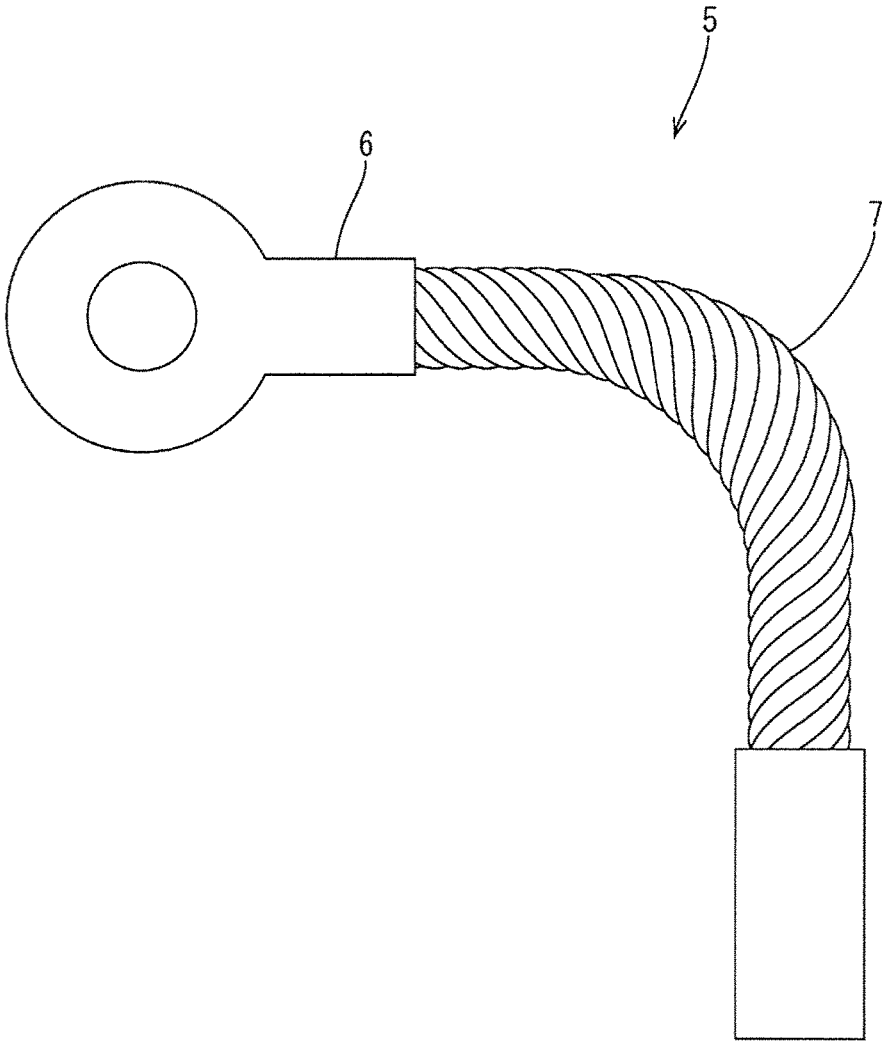
FIG. 9 PRIOR ART
FIG. 9 is a front view of a conventional wire with a bent fixed end.

A wire W4 with bent portions 320 having a different shape is described using FIGS. 6 and 7. Note that the same components as in the first embodiment are denoted by the same reference signs and not described. Further, each strand conductor 11 is not shown to simplify the drawing.

In this embodiment, as shown in FIG. 6, the wire W4 as one type of the wire shown in FIG. 1 includes two bent portions 320 having a bent shape with a curvature K4 and a straight portion 330 linearly connecting between the respective bent portions 320. The bent portions 320 and the straight portion 330 are provided in a part where a core 13 formed by twisting strand conductors 11 at a twist pitch P4 is exposed.

Each bent portion 320 is bent with the same curvature K4 such that a line along the wire W4 between a bend start point S, U and a bend end point T, V of the bent portion 320 forms an arc of approximately 90°. The straight portion 330 is provided between the bent portions 320. A part of the wire W before a part where the bent portions 320 are provided (start point S) is a straight front end part 340, and a part behind the part where the bent portions 320 are provided (end point V) is a straight rear end part 350. The wire W4 is bent three-dimensionally such that the front end part 340 and the rear end part 350 are twisted with respect to each other.

A center axis of a first bent portion 320A is disposed on a virtual plane X defined by a center axis of the front end part 340 and a center axis of the straight portion 330. Further, a center axis of a second bent portion 320B is disposed on a virtual plane Y defined by the center axis of the straight portion 330 and a center axis of the rear end part 350. The virtual planes X and Y are perpendicular.

A section length L4A of the first bent portion 320A is ½ of the twist pitch P4 and a section length L4B of the second bent portion 320B is also ½ of the twist pitch P4. That is, the sum of the section lengths L4A, L4B is an integer multiple of the twist pitch P4. Further, a section length L4C of the straight portion 330 is ¼ of the twist pitch P4.

As shown in FIGS. 6 and 7, a difference D between inner and outer circumferences at the bend end point V (boundary position between the second bent portion 320B and the rear end part 350) is 0 in the wire W4. Note that, in FIG. 7, relationships between the length from the bend start position S and the difference D between inner and outer circumferences of a wire having a center axis located on the virtual plane X and bent with the curvature K4 and a wire having a center axis located on the virtual plane Y and bent with the curvature K4 are drawn in broken lines. Since the virtual planes X and Y are perpendicular and the wires are bent with the same curvature K4, relationships with the difference D between inner and outer circumferences and the like due to bending also move parallel in a length direction. Further, a relationship between the length of the wire W4 from the bend start point S and the difference D between inner and outer circumferences is drawn in a solid line.

The section length L4A of the first bent portion 320A on the virtual plane X is ½ of the twist pitch P4 (P4/2), and the difference D between inner and outer circumferences of the first bent portion 320A at the end point T is largest. Then, the difference D between inner and outer circumferences at the start point U of the second bent portion 320B having the center axis disposed on the virtual plane Y perpendicular to the virtual plane X is made equal to the difference D between inner and outer circumferences at the end point T of the first bent portion 320A. That is, the difference D between inner and outer circumferences at the start point U of the other bent portion 320B is set largest.

A case is described where the difference D between inner and outer circumferences at the start point U of the second bent portion 320B becomes equal to the difference D between inner and outer circumferences at the end point T of the first bent portion 320A as just described. In the wire having the center axis on the virtual plane Y, the difference D between inner and outer circumferences is largest at a position where the length from the bend start point S is ¾ of the twist pitch P4 (3P4/4). Thus, if the position where the length from the bend start point S is ¾ of the twist pitch P4 (3P4/4) is the start point U of the second bent portion 320B, the difference D between inner and outer circumferences at the start point U of the second bent portion 320B becomes equal to the difference D between inner and outer circumferences at the end point T of the first bent portion 320A.

The section length L4C of the straight portion 330 for setting such a start point U of the second bent portion 320B is described. The end point T of the first bent portion 320A is a position where the length from the bend start point S is ½ of the twist pitch P4 (P4/2). The start point U of the second bent portion 320B is a position where the length from the bend start point S is ¾ of the twist pitch P4 (3P4/4). Thus, the section length L4C of the straight portion 330 may be set as a difference between these lengths and is, specifically, ¼ of the twist pitch P4.

Further, the sum of the section lengths L4A, L4B of the bent portions 320A, 320B is an integer multiple of the twist pitch P4 and each bent portion 320 is bent with the same curvature K4. Thus, if the difference D between inner and outer circumferences at the start point U of the second bent portion 320B becomes equal to the difference D between inner and outer circumferences at the end point T of the first bent portion 320A, the difference D between inner and outer circumferences and excesses and deficiencies dL of the respective strand conductors 11 caused in the first bent portion 320A and the difference D between inner and outer circumferences and the excesses and deficiencies dL of the respective strand conductors 11 caused in the second bent portion 320B cancel out each other as in the third embodiment.

That is, when the sum of the section length L4A, L4B of the two bent portions 320A, 320B is an integer multiple of the twist pitch P4, route lengths of the respective strand conductors 11 in the case of summing the respective bent portions 320 become equal. Further, by setting the virtual planes X, Y, where the bent portions 320A, 320B are disposed, perpendicular to each other and setting the section length L4C of the straight portion 330 at an integer multiple of ¼ of the twist pitch P4, the start point U of the other bent portion 320B is reached with the excesses and deficiencies dL of the strand conductors 11 and the difference D between inner and outer circumferences caused in the one bent portion 320A maintained.

As described above, according to the fourth embodiment, the wire W4 has strand conductors 11 twisted at the predetermined twist pitch P4 and includes the two bent portions 320 having a bent shape with the predetermined curvature K4 and the straight portion 330 linearly connecting between the respective bent portions 320. The virtual planes X, Y where the center axes of the respective bent portions 320A, 320B are disposed are perpendicular. Additionally, the sum of the section lengths L4A, L4B of the respective bent portions 320 is set at an integer multiple of the twist pitch P3 and the section length L4C of the straight portion 330 is set at an integer multiple of ¼ of the twist pitch P4.

As just described, if the wire W4 is bent three-dimensionally and includes the straight portion 330 between the bent portions 320, the wire W4 can be bent without the flexibility thereof being impaired. Further, the bent portion 320 does not bulge even if the end of the wire W4 is fixed.

In a method for bending the wire W4 in which the plurality of strand conductors 11 are twisted at the predetermined twist pitch P4, the wire W4 includes the two bent portions 320 and the straight portion 330 linearly connecting between the respective bent portions 320. The wire W4 is bent such that the section length of the straight portion 330 is an integer multiple of ¼ of the twist pitch P4, whereas the two bent portions 320A, 320B are bent with the same curvature K4 and the center axes thereof are respectively disposed on the perpendicular virtual planes X, Y. Additionally, the sum of the section lengths L4A, L4B of these two bent portions 320 is an integer multiple of the twist pitch P4.

Other Embodiment

The invention disclosed by this specification is not limited to the above described and illustrated embodiments. For example, the following modes are also included.

Although the bent portion 20, 120, 220, 320 is provided at the position where the insulation coating 15 is stripped to expose the core 13 in the first to fourth embodiments, the bent portion may be coated with the insulation coating 15.

Although the bent portion 20 is bent substantially at 90° in the first embodiment, the bent portion may be bent at a different angle.

Although the wire W3 includes two bent portions 220 in the third embodiment, the wire may include three or more bent portions.

Although each bent portion 220, 320 is bent substantially at 90° in the third and fourth embodiments, the bent portion may be bent at a different angle. For example, one bent portion may be bent at 45° and the other bent portion may be bent at 135°. Further, the section lengths of the bent portions may be different.

LIST OF REFERENCE SIGNS

11 . . . strand conductor
13 . . . core
15 . . . insulation coating
20, 120, 220(A, B), 320(A, B) . . . bent portion
230, 330 . . . straight portion
340 . . . front end part
350 . . . rear end part
W, W1, W2, W3, W4 . . . wire
L, L1, L2, L3A, L3B, L3C, L4A, L4B, L4C . . . section length
P, P1, P2, P3, P4 . . . twist pitch
R1 . . . radius of curvature
K1, K2, K3, K4 . . . curvature
dL . . . excess and deficiency
D . . . difference between inner and outer circumferences
X, Y . . . virtual plane

The invention claimed is:

1. A wire in which a plurality of strand conductors are twisted at a predetermined twist pitch, the wire including a bent portion having a bent shape with a predetermined curvature in a part, wherein:

a section length of the bent portion is an integer multiple of the twist pitch.

2. A wire in which a plurality of strand conductors are twisted at a predetermined twist pitch, the wire including a plurality of bent portions and a straight portion linearly connecting between the respective bent portions, wherein:

the sum of section lengths of the respective bent portions and the sum of section lengths of the straight portions are both an integer multiple of the twist pitch.

3. The wire of claim 2, wherein:

the plurality of bent portions comprise first and second bent portions; and the section lengths of the first and second bent portions are equal and each is half the integer multiple of the twist pitch.

* * * * *